United States Patent [19]

Fuss

[11] 4,261,480

[45] Apr. 14, 1981

[54] ARTICLE HOLDER AND DISPENSER INCLUDING ADJUSTABLE DISPENSING MEANS AND METHOD

[75] Inventor: Gunter G. Fuss, San Carlos, Calif.

[73] Assignee: Safe-T Pacific Company, Redwood City, Calif.

[21] Appl. No.: 79,708

[22] Filed: Sep. 28, 1979

[51] Int. Cl.[3] ..... A47F 1/08

[52] U.S. Cl. ..... 221/304; 221/310

[58] Field of Search ..... 221/304, 207, 308, 309, 221/310, 44, 1, 241

[56] References Cited

U.S. PATENT DOCUMENTS

| | | | |
|---|---|---|---|
| 2,606,087 | 8/1952 | Tansley | 221/207 X |
| 2,780,388 | 2/1957 | Stephenson | 221/304 X |
| 3,790,023 | 2/1974 | Filipowicz | 221/310 X |

*Primary Examiner*—Allen N. Knowles

*Attorney, Agent, or Firm*—Flehr, Hohbach, Test

[57] ABSTRACT

An article holder and dispenser including an elongate hollow container especially suitable for storing and dispensing nested articles such as ice cream cones, cups and the like is disclosed herein along with a particular arrangement for releasably retaining articles of different sizes at the discharge end of the container. This arrangement utilizes a plurality of article retaining elements having resilient but wear resistent article retaining segments located within the hollow container adjacent its discharge opening for establishing the effective size of the opening and for releasably retaining the articles to be dispensed. These elements also include support segments respectively located within and slidably movable along the lengths of cooperating circumferential slots in the container for supporting the article retaining portions in adjustable positions around the periphery of the latter and relative to one another, whereby to vary the effective size of the discharge opening depending upon the size of the articles to be stored and dispensed. A locking ring is provided for maintaining the support segments fixed within their respective slots once their positions are selected, thereby fixing the effective size of the opening.

17 Claims, 11 Drawing Figures

ARTICLE HOLDER AND DISPENSER INCLUDING ADJUSTABLE DISPENSING MEANS AND METHOD

BACKGROUND OF THE INVENTION

The present invention relates generally to article holding and dispensing apparatus and more particularly to a specifically designed adjustable release arrangement for varying the effective size of the discharge opening defined by the apparatus so as to releasably retain articles such as ice cream cones, cups and the like of different sizes.

Presently, there are many different types of article storing and dispensing devices in the prior art including an article release arrangement of one form or another. In some of these devices the article release arrangements are fixed for establishing a discharge opening of fixed size. In others, the article release arrangements are adjustable for varying their associated discharge openings.

While many of the various article storing and dispensing apparatus appear to be generally satisfactory for their intended purpose, they do include certain drawbacks. For example, the actual article retaining elements comprising part of their overall article retaining arrangements are, in most cases, constructed of a rigid material or of bristles, especially in the case of the fixed arrangements. The bristles have a tendency to wear and the harder retaining elements have a greater tendency than softer ones to damage the article being releasably retained, especially fragile articles such as ice cream cones. In any event, the harder elements do not accommodate even limited variations in the size of the articles being dispensed for a given discharge opening size.

A more recent improvement in the adjustable type article holding and dispensing apparatus is disclosed in applicant's own U.S. Pat. No. 4,079,858. There, at least one but preferably a plurality of U-shaped clips are used to releasably embrace and flatten a lower edge portion of a cooperating container also comprising part of the overall apparatus. In this way, depending upon where the clips are located, the size of the discharge opening at the bottom of the container can be varied. While this particular adjusting technique is relatively uncomplicated there is nevertheless still room for improvement in this regard.

As will be seen hereinafter, the article storing and dispensing assembly disclosed herein and provided in accordance with the present invention is one which also utilizes adjustable article retaining elements. However, as will be seen, these retaining elements are nevertheless supported for movement in an uncomplicated and economical way and in a way which does not require that their associated container be flattened or otherwise deformed in the process. In addition, the article retaining elements are of particular design which, in contrast to the hard retaining elements in the prior art, reduces the possibility of damage to the articles being retained. At the same time, the present article retaining elements are designed to resist wear and damage to themselves in contrast to the bristle type elements previously used.

OBJECTS AND SUMMARY OF THE INVENTION

In view of the foregoing, one object of the present invention is to provide an adjustable article storing and dispensing assembly of the general type which utilizes retainer elements for releasably retaining nested articles such as ice cream cones, cups and the like located within an elongate hollow container also comprising part of the overall assembly.

A more particular object of the present invention is to provide an adjustable article storing and dispensing assembly and method of varying the effective size of its discharge opening utilizing article retainer elements which are supported for movement to different adjusted positions in an uncomplicated and economical way and one which does not require flattening or otherwise deforming its associated container.

Another particular object of the present invention is to provide specific retainer elements which are designed to minimize the possibility of damage to the articles being stored and dispensed, even fragile articles such as ice cream cones and the like.

Still another particular object of the present invention is to provide retainer elements which are resistent to wear, while, at the same time, being sufficiently resilient to minimize damage to the articles being retained and to accommodate to a limited extent variations in the size of the articles being dispensed for a given discharge opening size.

As will be seen hereinafter, the article storing and dispensing assembly disclosed herein is one which is especially suitable for nested articles such as ice cream cones, cups and the like, as stated previously. This assembly includes an elongate hollow container, preferably an annular one, which is provided for storing the nested articles and which defines a discharge opening at one end thereof for dispensing the articles therethrough. The assembly also includes a plurality of circumferentially spaced article retaining elements located within the container adjacent its interior surface and also adjacent the periphery of its discharge opening. These retaining elements serve to protrude into the discharge opening for establishing the effective size of the latter and also for releasably retaining the articles to be dispensed.

In accordance with one aspect of the present invention, all of the article retaining elements are supported for limited circumferential movement relative to one another around and adjacent the interior of the container for varying the effective size of its discharge opening and this is accomplished without moving any of the elements radially and without distorting the shape of the container itself. Once the positions of the article retaining elements are selected, depending upon the desired size of the discharge opening, they are maintained fixed by suitable means also comprising part of the overall assembly.

In a preferred embodiment, the foregoing is accomplished by supporting the article retaining elements in elongated circumferentially extending slots which are provided through the container and which are spaced from one another about the periphery of the latter. To this end, the article retaining elements include support segments respectively located within and slidably movable along the lengths of the slots to selected positions around the periphery of the container, thereby positioning the article retaining elements in the desired manner for adjusting the effective size of the discharge opening.

In accordance with another aspect of the present invention, the article retaining elements themselves are designed in a specific way to minimize damage to the articles being retained while, at the same time, displaying a high degree of resistance to wear, as stated previously. This is accomplished by providing each retaining element with a resilient core, for example one constructed of foam rubber, foamed elastomer or other resilient relatively soft material, and an outer protective wrapping, for example vinyl, which extends around the core from one lengthwise end of the latter to its opposite end. The core provides the needed resilience to minimize damage to the articles being retained and to accommodate to a limited extent size variations in the articles and the outer wrapping provides the needed protection against wear. In a preferred embodiment, the outer wrapping itself is embossed (roughened) to serve as a friction pad and is provided with an extension. The extension serves as the previously discussed support segment and is an integral part of the wrapping to minimize the possibility of separation from the rest of the retaining element during normal use of the latter.

DETAILED DESCRIPTION

Figure 1:
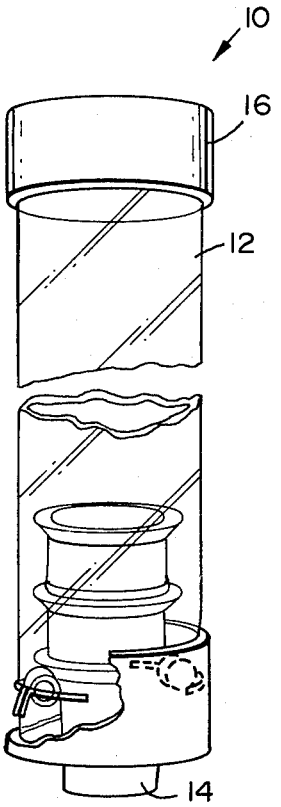
FIG. 1 is a partially broken away perspective view of an article holding and dispensing apparatus designed in accordance with the present invention.

Turning to the drawings, wherein like components are designated by like reference numerals throughout the various figures, an article holding and dispensing assembly designed in accordance with the present invention is illustrated in FIGS. 1 to 4 and generally designated by the reference numeral 10. As seen best in FIGS. 1 and 2, this assembly includes an elongate hollow cylindrical tube or container 12 for storing therein nested articles such as fragile baked ice cream cones or cups, fragile drinking cups such as foam insulated cups or the like. In the embodiment illustrated, a stack of ice cream cones 14 are maintained within the container and will be referred to throughout the following discussion. However, it is to be understood that the present invention is not limited to these particular articles.

Figure 3:
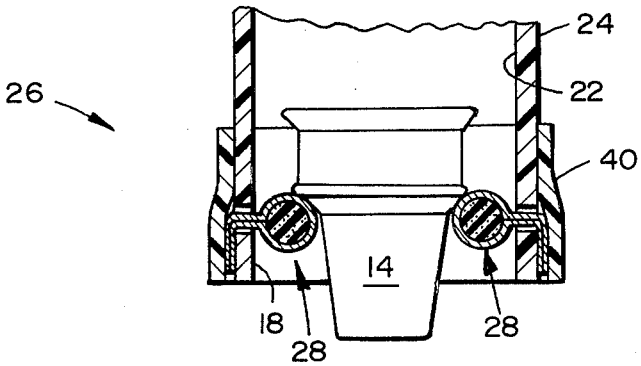
FIG. 3 is a vertical sectional view of the bottom end of the assembly of FIG. 1, specifically showing how an ice cream cone is retained therein.

In a preferred embodiment, container 12 is formed of a plastic material which may or may not be transparent and which is not necessarily flexible as required in applicant's previous U.S. Pat. No. 4,079,858 discussed above. However, like the container disclosed there, container 12 may carry a top closure or cap 16 at its top end for preventing entry of foreign objects or contamination. As best seen in FIG. 3, its bottom end is opened so as to provide a discharge opening generally indicated at 18 for passage of ice cream cones 14. While not shown, suitable means such as the supporting rings described in the last-mentioned patent may be provided for supporting the entire assembly in a fixed, vertically extending position such as the one shown in FIG. 1. In a preferred embodiment, four containers are supported on and around a single support stand.

For reasons to be discussed hereinafter, container 12 includes a pair of elongated circumferentially extending slots 20 spaced from one another around its periphery slightly above and equal distances from open end 18. In the embodiment shown, these slots which extend entirely through container 12 from its interior surface 22 to its exterior surface 24 (see FIG. 3) are equal lengths circumferentially and are spaced diametrically opposite one another.

Referring specifically to FIG. 3, assembly 10 is shown including an arrangement 26 for releasably retaining cones 14 at the discharge end 18 of container 12 while, at the same time, establishing an effective size for the discharge opening. As will be seen hereinafter, this arrangement uses article retaining elements 28 which are designed in accordance with the present invention and which are supported for movement in accordance with the present invention for adjusting the effective size of discharge opening 18.

Figure 2:
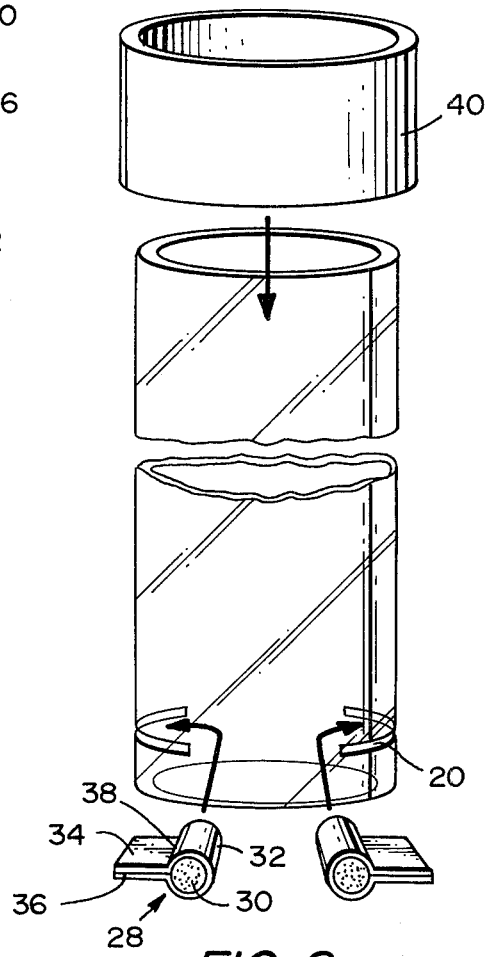
FIG. 2 is an enlarged exploded perspective view of the assembly illustrated in FIG. 1.

There are two article retaining elements 28 comprising part of arrangement 26 as best shown in FIGS. 2 and 3, one for each circumferential slot 20. Each article retaining element includes a cylindrical core 30 constructed of relatively resilient material, specifically foam rubber in a preferred embodiment, which serves to minimize damage to the cones as the latter pass between the retaining elements in the manner to be described hereinafter and which to a limited degree accommodates for size variations in the articles being releasably retained. Each article retaining element also includes an outer protective wrapping 32 which extends around its associated core from one lengthwise end of the latter to its opposite end. This wrapping is constructed of material sufficiently pliable so as to retain at least most of the resiliency of its inner core while, at the same time, displaying a greater degree of resistance to wear than the inner core. In a preferred embodiment the wrapping is vinyl having a thickness of about 5 mils. Moreover, in this preferred embodiment, the outer surface of the wrapping is embossed (roughened) to serve as a friction pad if needed.

The core 30 and outer wrapping 32 just described together comprise the article retaining segment of each element 28. However, each element also includes a support segment which, in a preferred embodiment, is comprised of opposite end sections 34 and 36 of outer wrapping 32. These end sections extend out beyond the core leaving a lengthwise section therebetween to serve as wrapping 32. In order to maintain the wrapping around core 30, the wrapping is joined to itself along a lengthwise seam 38 inward of end sections 34 and 36 and adjacent to core 30. This seam may be sewed in place by means of thread, it may be stapled, glued or heat sealed where, for example, vinyl or similar material is used. In any case, a single substantially longer article retaining element than the one shown is preferrably constructed and eventually cut into a number of individual elements. For reasons to become apparent hereinafter, each of these individual elements is significantly shorter in length than the circumferentially extending length of slots 20, e.g., ¾ inch long.

Figure 4A:
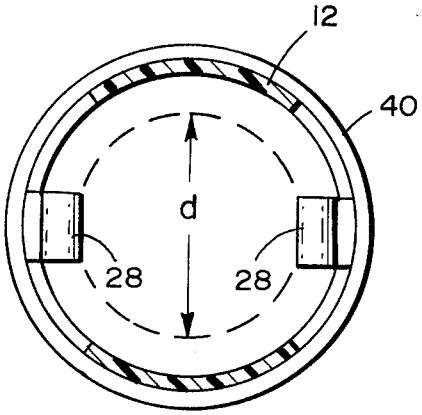
FIG. 4A and 4B are diagrammatic illustrations in plan view of the bottom end of the assembly of FIG. 1, particularly illustrating the way its discharge opening is varied in size.
Figure 4B:
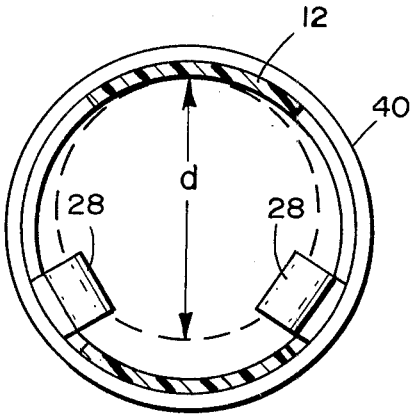

As illustrated best in FIG. 3, the article retaining segments of elements 28 are located within container 12 adjacent discharge opening 18 at the bottom end of the container for establishing the effective size of the opening and for releasably retaining cones 14, one at a time, just above the opening. The support segments of elements 28, that is, the end sections 34 and 36 of wrappings 32 are respectively located within and slidably movable along the lengths of slots 20 for supporting their article retaining segments in adjustable positions around the periphery of container 12 and relative to one another. In this way the effective size of discharge opening 18 can be varied between two extremes as seen best in FIGS. 4A and 4B. Referring specifically to FIG. 4A, the article retainer elements are disposed on diametrically opposite sides of the container so as to define an effective annular discharge opening which has a diameter d and which is the smallest or tightest annular opening which can be provided by the two elements. In order to enlarge the opening the two elements are moved from their FIG. 4A position circumferentially toward one another along the interior of container 12. This causes the effective discharge opening to increase a maximum amount when the two retaining elements are as close as possible to one another as indicated by the diameter d' in FIG. 4B. By circumferentially moving the elements 28 toward or away from one another between the two extremes shown in 4A and 4B the size of the effective discharge opening can be varied between its minimum diameter d and its maximum diameter d'.

It should be apparent from the foregoing that the adjustability of discharge opening 18 is carried out without moving the article retaining segments of elements 28 radially inward or outward with respect to container 12 and it is done without complicated support means. Moreover, it is not necessary to flatten or otherwise deform container 12 in order to accomplish this. All that is neceessary is that one or both of the elements be moved along their respective slots. Once their positions are selected, the support portions are maintained fixed by means of a locking ring 40 which fits tightly but slidably around container 12 and over slots 20 so as to lock the support segments between the exterior 24 of container 12 and ring 40, as best seen in FIG. 3. This, in turn, fixes the position of each article retaining portion. To readjust their positions all that is necessary is to slide the locking ring out of the position shown in FIG. 3, and thereafter slide one or both of the support portions to a different position and thereafter slide the locking ring back into its FIG. 3 position.

Figure 5:
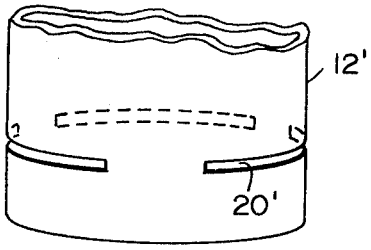
FIG. 5 is a perspective view illustrating the bottom of an article holding and dispensing assembly designed in accordance with a second and preferred embodiment of the present invention.
Figure 6D:
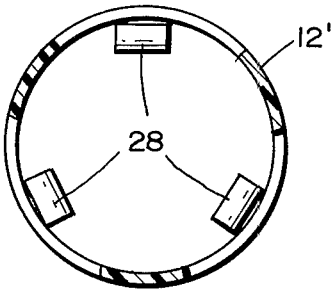
FIGS. 6A, 6B, 6C and 6D are diagrammatic illustrations in plan view of the bottom end of the assembly of FIG. 5, particularly illustrating the way its discharge opening is varied in size.
Figure 6A:
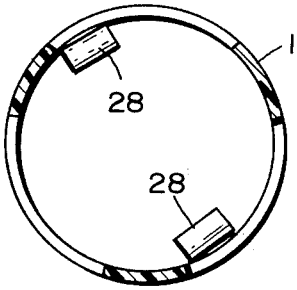
Figure 6B:
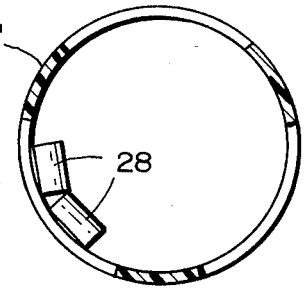
Figure 6C:
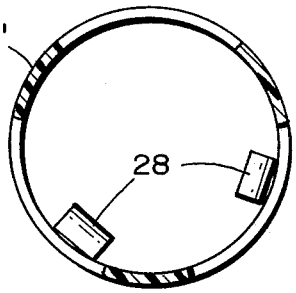

It should also be apparent from the foregoing that the adjustability of arrangement 27 requires the use of two or more article retaining elements and one or more slots depending on the length and positions of the slots. For example, a single slot could provide the extremes shown in FIGS. 4A and B if the single slot is sufficiently long. In a preferred embodiment, three equally circumferentially spaced slots are provided in the container and arrangement 26 contains two or three article retaining elements. The bottom end section of the container including three such slots is shown in FIG. 5. This container is generally indicated by the reference numeral 12' and the slots are indicated at 20'. An overall article holding and dispensing assembly utilizing a container with these three slots and article retaining elements will otherwise be identical to assembly 10 described abobe. FIGS. 6A–6D illustrate how two or three retaining elements can be used with container 12'. FIG. 6A illustrates the tightest configuration (smallest discharge opening), FIG. 6B the loosest configuration (largest opening) and FIG. 6C an intermediate configuration. FIG. 6D shows one way of using three retaining elements with container 12'.

Whether two or three slots are used and two or three retaining elements, it should be apparent that the resiliency or give in the retaining elements accommodates articles which fluctuate in size, of course to a limited extent. It should also be apparent that the retaining segments are subject to abuse each time a cone or similar article is drawn past them. However, as stated previously, their outer wrappings protect these segments against wear as a result of this abuse. Moreover, because each support segment (end sections 34 and 36) is integrally formed with a wrapping, this minimizes the possibility of inadvertently separating the retaining segment from its support segment as a passing article being withdrawn tends to pull the former downward and away from the latter.

Figure 7:
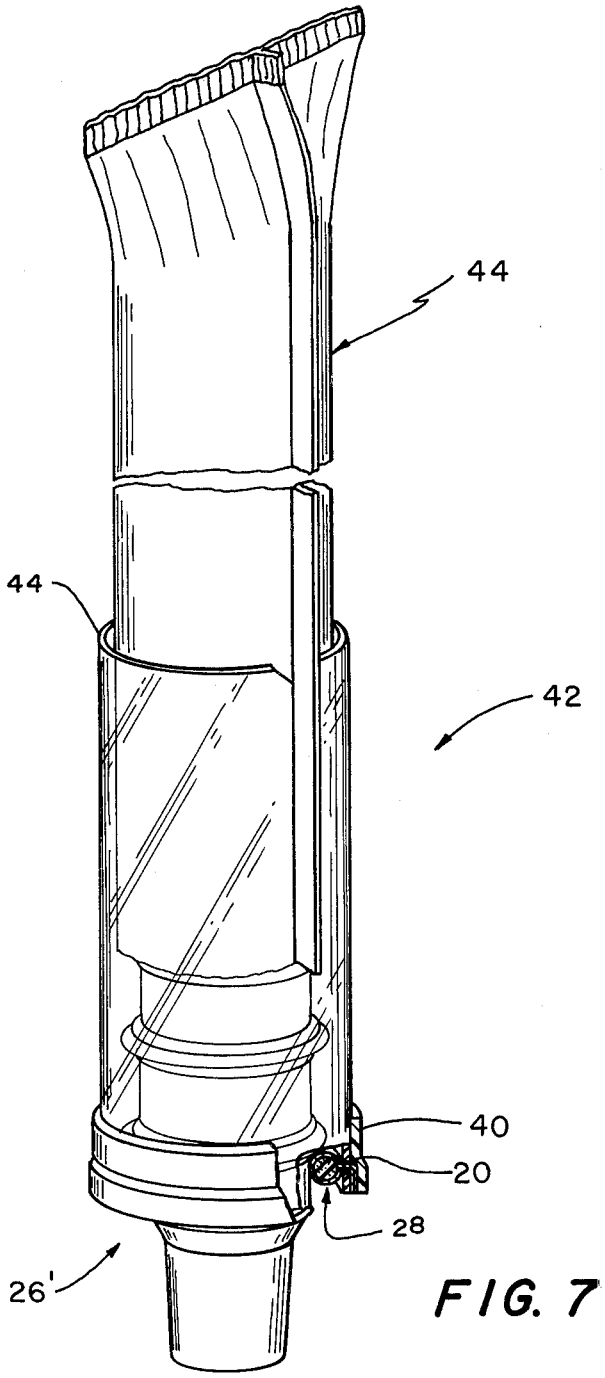
FIG. 7 is a partially broken away perspective view of an article holding and dispensing apparatus including the dispensing means shown in the previous figures in combination with an article containing package.

Referring now to FIG. 7, attention is directed to an article holding assembly 42 including its own arrangement 26' for releasably retaining cones 14. Apart from this arrangement, overall assembly 42 may be identical to any of the article holding assembly embodiments disclosed in U.S. Pat. application, Ser. No. 019,593, to FUSS et al, filed Mar. 12, 1979, and assigned to the assignee of the present application. In the particular embodiment shown in FIG. 7, assembly 42 includes a self-contained package 44 of ice cream cones or the like of the type disclosed in the Fuss et al application. Assembly 42 also includes a container 44 which may be identical to any of the container embodiments disclosed in the Fuss et al application with one exception. Container 44 includes slots 20 (one of which is shown) comprising part of arrangement 26. The arrangement also includes article retaining elements 28 (one of which is shown) and a locking ring 40 which cooperate with one another to releasably retain cones 14 within container 44 and vary the size of the discharge opening in the bottom of the container in the manner described previously. Arrangement 26 is to be contrasted with the clip members disclosed in the previously recited Fuss et al application.

What is claimed is:

1. An article holder and dispenser for nested articles such as ice cream cones, cups and the like comprising an elongate hollow container means for storing the articles therein, said container means having an interior surface and defining a discharge opening at one end thereof for dispensing the articles therethrough, a plurality of circumferentially spaced article retaining means located within said container means adjacent its interior surface and the periphery of said discharge opening and serving to protrude into the discharge opening for establishing the effective size of said opening in order to releasably retain the articles to be dispensed, means supporting all of said retaining means for limited circumferential movement adjacent the interior surface of said container means and relative to one another for varying the effective size of said discharge opening without distorting the shape of said container means and means for releasably maintaining said retaining means in adjustably fixed circumferential positions relative to one another, whereby to fix the effective size of said opening.

2. An article holder and dispenser according to claim 1 wherein said container means includes a plurality of elongated circumferentially extending through slots at least equal in number to said retaining means and spaced from one another around its periphery and wherein said supporting means includes an equal plurality of elongated tabs shorter in elongation than said slots, each of said tabs being connected with and extending out from an associated one of said retaining means, said tabs being respectively located within and slidably movable along the lengths of associated ones of said slots for supporting said retaining means for said limited circumferential movement.

3. An article holder and dispenser according to claim 2 wherein each of said article retaining means includes a core and an associated outer wrapping which extends around said core from one lengthwise end of the latter to its opposite end and which, together with said core, provides suffient resiliency for releasably retaining said articles without damaging the latter while at the same time accommodating to a limited extent size variations in the articles to be dispensed for a given size of said discharge opening, said core and outer wrapping of each retaining means being located lengthwise against the interior surface of said container means regardless of their positions relative to one another.

4. An article holder and dispenser according to claim 3 wherein each of said outer wrappings includes an integral end section extending out beyond its associated core and serving as at least part of an associated tab sufficiently long to extend into and through an associated one of said slots and sufficiently thin relative to said slot to slide in the latter.

5. An article holder and dispenser according to claim 4 wherein said wrapping end sections extend through their associated slots from the interior of said containing means to the exterior thereof and wherein said maintaining means includes a locking ring located around and slidable along said container means for disengagably maintaining said end sections in fixed position against the outer surface of said container means whereby to fix the effective size of said discharge opening.

6. An article holder and dispenser according to claim 4 wherein each of said outer wrappings includes a second opposite integral end section extending out beyond its associated core and serving as a second part of an associated tab, said outer wrapping being joined to itself along a lengthwise seam inward of said opposite end sections adjacent its associated core for holding the latter in place.

7. An article holder and dispenser according to claim 6 wherein the outer surface of said wrappings are roughened so as to serve as friction pads.

8. An article holder and dispenser according to claim 1 wherein said container means includes at least one circumferentially extending through slot extending part way around its periphery and wherein said supporting means includes a plurality of tabs connected with and extending out from said retaining means, each of said tabs being narrower lengthwise than said slot and being located within and slidable along said slot for supporting said retaining means for said limited circumferential movement.

9. An article holder and dispenser according to claim 2 wherein said container means includes at least one more of said through slots than said retaining means.

10. In an article holder and dispenser for storing and dispensing nested articles such as ice cream cones, cups and the like, an elongate hollow container of cylindrical configuration defining a discharge opening at one end thereof for passage of said articles, said container including a plurality of circumferentially extending through slots spaced from one another around its periphery, an equal plurality of retainer elements respectively including article retaining segments located within said container adjacent said discharge opening for establishing the effective size of said opening for releasably retaining the articles to be dispensed, said retainer elements also including support segments respectively located within said slidably movable along the lengths of said slots for supporting said article retaining segments at adjustable positions around the periphery of said container and relative to one another whereby to vary the effective size of said discharge opening, and means for maintaining said support segments in fixed positions within their respective slots whereby to fix the effective size of said opening.

11. An article holder and dispenser according to claim 10 wherein each of said article retaining segments includes a resilient core and an outer protective wrapping which extends around said core from one lengthwise end of the latter to its opposite end and which, together with said core, provides sufficient resiliency for releasably retaining said articles without damaging the latter while, at the same time, accommodating size variations in the article to be dispensed for a given size of said discharge opening, said retaining segments being located against the interior surface of said container regardless of their positions relative to one another.

12. An article holder and dispenser according to claim 11 wherein each of said outer wrappings includes an integral end section extending out beyond its associated core and serving as at least part of an associated support segment.

13. An article holder and dispenser according to claim 12 wherein said wrapping end sections extend through their associated slots from the interior of said container to the exterior thereof and wherein said maintaining means includes a locking ring located around and slidable along said container for disengagably maintaining said end sections in fixed positions against the outer surface of said container whereby to fix the effective size of said discharge opening.

14. An article holder and dispenser according to claim 13 wherein each of said outer wrappings includes a second opposite integral end section extending out beyond its associated core and serving as a second part of an associated support segment, said outer wrapping being joined to itself along a lengthwise seam inward of said opposite end sections and adjacent its associated core for holding the latter in place.

15. An article holder according to claim 10 wherein said container includes at least one more slot than said retainer elements.

16. In a dispensing device, means for releasably retaining stacked articles stored at the discharge end of and within an elongate hollow container, said container being of a type for dispensing said stored articles through said opening, said means comprising a retainer element including an article retaining segment adapted to be located within said container adjacent said discharge opening for establishing the effective size of said opening in order to releasably retain said articles of predetermined size and means for supporting said retaining segment in a fixed position within said container, said retaining segment including a resilient core and an outer protective wrapping which extends around said core from one lengthwise end of the latter to its opposite end and which, together with said core, provides sufficient resiliency for releasably retaining said articles without damaging the latter while, at the same time, accommodating to a limited extent size variations in the articles to be dispensed from a given size of said discharge opening, said retaining segment being adapted for positioning against the interior surface of said container and said supporting means including an integrally formed end section of said outer wrapping extending out beyond said core and adapted to be connected with said container.

17. A retainer element according to claim 16 wherein said outer wrapping includes a second opposite integral end section extending out beyond said core and serving as a part of said support means, said outer wrapping being joined to itself along a lengthwise seam inward of said opposite end sections and adjacent said core for holding the latter in place.

* * * * *